US011180705B2

(12) United States Patent
Milam et al.

(10) Patent No.: US 11,180,705 B2
(45) Date of Patent: Nov. 23, 2021

(54) PROCESS FOR UPGRADING ULTRALIGHT CRUDE OIL AND CONDENSATES

(71) Applicants: Michael F. Milam, San Antonio, TX (US); Gerry Obluda, Lake Charles, LA (US)

(72) Inventors: Michael F. Milam, San Antonio, TX (US); Gerry Obluda, Lake Charles, LA (US)

( * ) Notice: Subject to any disclaimer, the term of this patent is extended or adjusted under 35 U.S.C. 154(b) by 0 days.

(21) Appl. No.: 16/552,123

(22) Filed: Aug. 27, 2019

(65) Prior Publication Data

US 2021/0062100 A1 Mar. 4, 2021

(51) Int. Cl.
*C10G 69/00* (2006.01)
*C10G 67/16* (2006.01)
*C10L 3/12* (2006.01)

(52) U.S. Cl.
CPC ..... *C10G 69/00* (2013.01); *C10G 67/16* (2013.01); *C10L 3/12* (2013.01); *C10G 2300/104* (2013.01); *C10G 2400/02* (2013.01); *C10G 2400/06* (2013.01); *C10L 2200/0415* (2013.01); *C10L 2270/023* (2013.01)

(58) Field of Classification Search
None
See application file for complete search history.

(56) References Cited

U.S. PATENT DOCUMENTS

| | | | | |
|---|---|---|---|---|
| 2008/0011643 | A1* | 1/2008 | Lenglet | C10G 67/00 208/58 |
| 2017/0058721 | A1* | 3/2017 | Noureldin | F01K 27/00 |
| 2017/0096609 | A1* | 4/2017 | Eizenga | C10G 67/02 |
| 2018/0155633 | A1* | 6/2018 | Al-Ghamdi | C10G 9/36 |
| 2018/0155641 | A1* | 6/2018 | Al-Ghamdi | B01D 3/143 |
| 2018/0155643 | A1* | 6/2018 | Al-Ghamdi | C10G 7/06 |
| 2019/0093026 | A1* | 3/2019 | Wohaibi | C10L 1/08 |
| 2019/0390120 | A1* | 12/2019 | Eizenga | C10G 67/02 |
| 2020/0181504 | A1* | 6/2020 | Myllyoja | C07C 45/41 |

* cited by examiner

*Primary Examiner* — Tam M Nguyen
(74) *Attorney, Agent, or Firm* — Nick Guinn; Gunn, Lee & Cave, P.C.

(57) ABSTRACT

A method comprising the steps of feeding condensate to a splitter unit; directing the resulting naphtha product to a naphtha hydrotreater and the resulting diesel product to a diesel hydrotreater; directing ULSD product from the diesel hydrotreater to ULSD storage and naphtha product from the diesel hydrotreater to the naphtha hydrotreater; directing treated naphtha product from the naphtha hydrotreater to a naphtha splitter; isomerizing the light naphtha product and reforming the heavy naphtha product; sending the isomerate and the reformate to a gasoline separator; directing the products to storage.

14 Claims, 4 Drawing Sheets

PROCESS FOR UPGRADING ULTRALIGHT CRUDE OIL AND CONDENSATES

CROSS REFERENCES TO RELATED APPLICATION

Not applicable.

FEDERALLY SPONSORED RESEARCH OR DEVELOPMENT

Not applicable.

BACKGROUND OF THE INVENTION

1. Field of the Invention

This invention relates to processing certain ultralight fluids, also referred to as crude oil and condensates, originating from oil and gas reservoirs utilizing hydraulic fracturing techniques. This invention produces high quality transportation fuels utilizing available technologies while minimizing the amount of equipment, piping, pumps, compressors, and ancillary equipment required by conventional petroleum refineries. The invention uses modular construction to the maximum practicable extent.

2. Description of the Related Art

With the advent of horizontal drilling and fracturing to produce natural gas, significant amounts of light liquid hydrocarbons began to be co-produced. Some of this production would occur when natural gas, with a high proportion of relatively heavy hydrocarbons, i.e. "wet" gas, cooled while being transported via underground pipelines. This "condensate" consisted primarily of pentanes and heavier hydrocarbons which could be processed by refineries in small amounts. As the technology of hydraulic fracturing progressed, "tight oil" became a desirable target for exploration and production ("E&P") firms. Tight oil, although different in composition from true condensate, is also very light and very different from traditional crude oil. Condensate is an amorphous term but is now used generally in the industry to describe produced light hydrocarbon that has an API gravity of 45 of more.

Somewhat recently, significant quantities of "tight oil" were produced and exceeded the limited capability of existing refineries to absorb this production. At that time, United States law prohibited the export of crude oil. Condensate fell under this ban and threatened to curtail the development of additional production. In June 2014, Enterprise Products and Pioneer Natural Resources received permission from the US Department of Commerce to export condensate after it had been "stabilized" by removing very light hydrocarbons such as ethane, propane, and butane. Despite this loophole, condensate continued to trade at a significant discount to crude oil. Condensate splitters began to be developed as an alternative which would to take advantage of the spread that had developed between the price of condensate and the value of the products produced from the splitter. In 2014, this spread exceeded $15/bbl, more than the margin refiners received for processing crude oil in a much more intensive and expensive process.

Hydrocarbon produced from geological formation can range in weight from methane, the primary component of natural, to asphaltene, the heaviest form found in asphalt or fuel oil. Condensate has been classified by many as any liquid hydrocarbon over 45 API. Due to the abundant production of hydrocarbons over 55 API from hydraulically fractured wells, the "superlight" condensate label has been coined to describe this type. Much of the production of condensate over 45 API has occurred from the classic condensation of hydrocarbons from wet gas production, much of it from hydraulically fractured wells that produce primarily crude oil.

Hydraulically fracturing techniques release a hydrocarbon liquid distinct from traditional wells. The tight oil is typically light-colored rather than black due to the absence of asphaltenes. When observed in a clear container, a hazy cloud is apparent in the bottom due to the waxy paraffins that are present. While fractionation of either a 45 API condensate or a 42 API WTI will produce LPG, naphtha, jet, diesel, and ATB, the relative amounts and qualities of these products are quite different from those of heavier crudes.

For instance, production in the Eagle Ford region of South Texas leads to products that are much more paraffinic than a typical WTI. This has several implications. First, products with a similar boiling range from either crude will have very different API gravities, with the tight oil being higher. For example, jet fuel from tight oil will have API gravity of more than 50, while WTI derived jet fuel will be around 45 API. This means that an apparently light tight oil will produce more usable products than would be expected. Second, high octane gasoline is much more difficult to produce from a paraffinic feedstock, resulting in a lower yield.

Tight oils have unusually low sulfur content in many cases. Sweet WTI, a low sulfur crude oil, has around 0.5 wt % sulfur or 5,000 ppm. By contrast, many tight oils have only 500-600 ppm sulfur in total.

The residual, or bottoms product, from tight oil has very little asphaltene. WTI, considered to be a light crude, will produce 5-10% asphalt, which is primarily composed of asphaltene. The absence of asphaltene allows tight oil bottoms to be used as high-quality low-sulfur gas oil, a premium feedstock suitable for FCC and hydrocracker processing.

The ratio of light/heavy naphtha for a tight oil is about 50/50. For WTI, that ratio is 25/75. WTI heavy naphtha is readily upgraded to high octane gasoline via a reformer. The light naphtha portion is usually blended with this high-octane material without being processed. Tight oil heavy naphtha can be reformed but requires much more severe conditions than WTI heavy naphtha. Tight oil light naphtha is much more difficult to blend off with the high-octane material due to its low octane and relative volume.

The present invention takes advantage of these differences in tight oil product properties and allows for a less expensive and more efficient refinery.

For reference, heavy naphtha is a distillation cut primarily made up of material roughly the same density as finished gasoline. Heavy naphtha molecules typically have from seven to nine carbon atoms having a boiling range typically between 180° F. to 330° F. The heavy naphtha is typically sent to the reformer to upgrade its quality to make it suitable as a gasoline blendstock. Heavy naphtha can also be blended directly into gasoline, but its low octane makes this undesirable. Light naphtha, on the other hand, can refer to either a finished product used as a petrochemical feedstock or a distillation cut commonly called light straight run naphtha. It is composed of pentane and slightly heavier material. In a refinery, light naphtha is often blended directly into gasoline. However, its low octane and relatively high vapor pressure typically limit it to five percent (5%) or less of the gasoline pool. To boost its octane, it is often sent to the isomerization unit before gasoline blending.

Most of the naphtha sent to the reformer must first be hydrotreated to remove impurities that are harmful to the reformer catalyst. The exception is naphtha from a hydrocracker, which is essentially already hydroteated.

Condensate splitters are relatively simple compared to either crude oil refineries or natural gas liquid (NGL) fractionators. In fact, a condensate splitter is very similar to the atmospheric crude distillation unit (ADU) used in almost every refinery.

Condensate is processed through a splitter by first being preheated to 200 F. The condensate is mixed with water and specialty chemicals and passed through a desalter to remove impurities. The condensate is further heated to around 600° F. in a direct-fired heater. As much as 80-90% of the condensate is vaporized in the heater. The mixture of vapor and liquid is introduced into a vertical distillation column where the vapor is cooled as it rises through a series of contacting trays. As the vapor cools, it condenses and collects on accumulation trays. Careful control of temperature within the column allows liquid hydrocarbons to be withdrawn from these trays that meet the specifications for diesel, jet fuel, heavy naphtha, and light naphtha. Uncondensed vapor leaves the top of column and is purified by removing hydrogen sulfide. The liquid which was not vaporized in the direct-fired heater is withdrawn from the bottom of the distillation column, cooled, and sent to storage. This stream will typically meet the specifications for low-sulfur gas oil.

A condensate splitter will be supported by tankage for incoming condensate and outgoing products including naphtha, jet fuel, diesel, and gas oil. Ancillary equipment including steam boilers, waste water treatment, cooling towers, air compressors, and others will also support the operation. Buildings for operations, maintenance, technical, clerical, and management staff will also be provided.

Due to simple configuration, the footprint for a large condensate splitter of 50,000 to 100,000 BPD can be as small as 10-20 acres, including tankage.

Midstream exploration and production firms have invested in processing facilities for several years, including: NGL fractionators; cryogenic gas processing; CO2 recovery; H2S recovery; propylene splitters; propane and butane dehydrogenation units. Processing applications within the midstream have several characteristics: input streams are easily characterized by composition; outputs are predictable and change very little over time; equipment is straightforward and reliable. Crude/condensate being produced from shale has similar characteristics and can be processed in plants that are relatively simple.

Advances in upstream oil and gas exploration have led to significant production of ultralight fluids, also referred to as crude oil or condensate, which possess properties that are unlike conventional crude oil. These ultralight fluids can be processed in conventional refineries but only to a limited extent due to their lack of similarity to conventional crude oil.

The ultralight fluids can be processed in a process designed specifically for its properties. By taking advantage of the differences between the ultralight fluids and conventional crude oil, the processing unit can be streamlined to a great extent, resulting in a smaller, economic package. Further, the optimized processing unit, i.e., the present invention, can be placed in unconventional and remote locations closer to the producing reservoirs where there is a significant demand for the finished products. Example locations include the Eagle Ford formation in South Texas; the Delaware Basin in West Texas; the Permian Basin in West Texas; the Utica formation in the US Midwest; and the Niobrara formation in Colorado and Wyoming.

The present invention is superior to other known processes because it: (1) requires a smaller footprint than most refineries; and (2) requires less equipment and operating units than most refineries; and (3) because it can be implemented at or near the drilling site rather than hundreds or thousands of miles away, it reduces transportation costs and logistics.

The present invention is further superior to other known methods and systems because: (1) minimal heat exchangers are required; (2) no amine processing equipment is required; (3) no Claus sulfur recovery unit, or associated tail gas recovery unit is required; (4) no water-cooled exchangers are required; (5) no cooling water tower is required; (6) minimal steam consumption occurs; (7) no debutanizer is required; (8) no intermediate storage tanks are required; (9) no hydrogen make-up compressor is required; (10) no hydrogen recycle compressor for ultra-low sulfur diesel is required; (11) common hydrogen recycle compressor for isomerization and reformer reduces time and expense of carrying out the process and system; (12) common product separator for isomerate and reformate reduces time and expense; (13) the system and process can be characterized by low severity reformer operation; and (14) a single heater for reformer charge heater, first pass reheater, and second pass reheater can be implemented.

BRIEF SUMMARY OF THE INVENTION

The invention is a system and method for processing ultralight fluid while producing ultra-low sulfur diesel ("ULSD"), low sulfur marine fuel oil, and other unfinished streams including off gas and naphtha.

The present invention is designed to upgrade condensate to valuable transportation fuels. Alternative embodiments provide a wide spectrum of capacities and yields. A condensate splitter is core of each facility. Such a condensate splitter splits condensate into light naphtha, heavy naphtha, diesel, and low sulfur fuel oil. Additional equipment upgrades each stream into finished products. For example, light naphtha is upgraded to high octane gasoline; heavy naphtha is upgraded to high octane gasoline; diesel is upgraded into ULSD. In several embodiments, the entire facility is constructed in modules capable of delivery via truck to site. The facility is highly automated to improve efficiency and minimize manpower. Given the simplicity of the present invention, it allows for run lengths of three to five years between maintenance outages.

One method of the present invention comprises the steps of feeding condensate to a splitter unit; directing the resulting naphtha product to a naphtha hydrotreater and the resulting diesel product to a diesel hydrotreater; directing ULSD product from the diesel hydrotreater to ULSD storage and naphtha product from the diesel hydrotreater to the naphtha hydrotreater; directing treated naphtha product from the naphtha hydrotreater to a naphtha splitter; isomerizing the light naphtha product and reforming the heavy naphtha product; sending the isomerate and the reformate to a gasoline separator; directing the products to storage.

BRIEF DESCRIPTION OF THE SEVERAL VIEWS OF THE DRAWINGS

For an improved understanding of the present invention, and the advantages thereof, reference is made to the following descriptions taken in conjunction with the accompanying figures.

DETAILED DESCRIPTION OF THE INVENTION

The present invention provides a process for upgrading ultralight fluid to finished products, said fluid consisting of these typical properties: API gravity between 46 and 58; sulfur content less than 0.1%; Reid vapor pressure between 5 and 15 psig; originating from reservoirs utilizing hydraulic fracturing techniques. The finished products include ultra-low sulfur diesel, meeting conventional industry specifications; low sulfur marine gas oil, meeting conventional industry specifications; low sulfur marine fuel oil, meeting conventional industry specifications; and regular gasoline, meeting conventional industry specifications.

Figure 1:
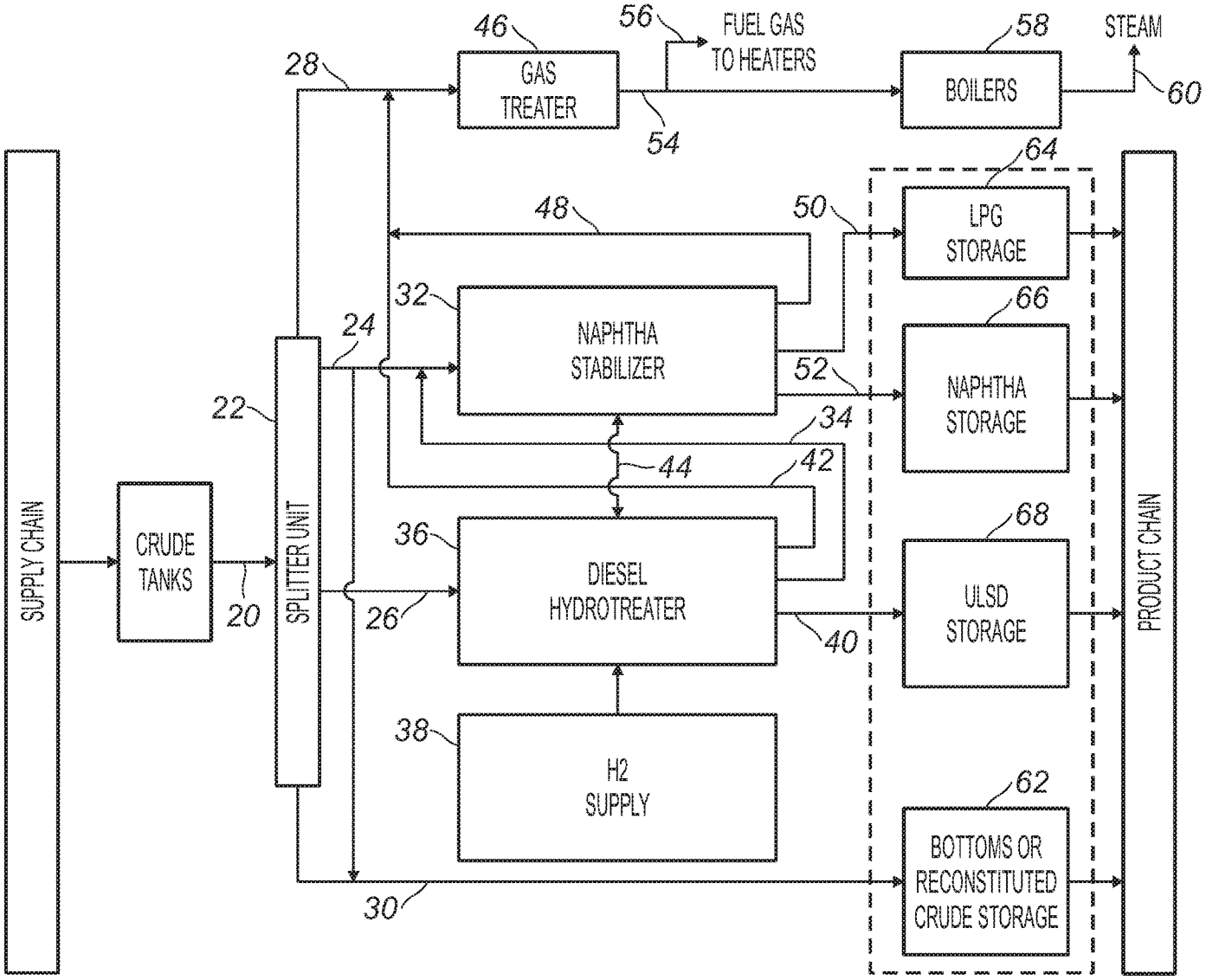
FIG. 1 is a block flow diagram schematic showing a refining system that may be used for upgrading ultralight crude oil and condensates.

FIG. 1 illustrates one embodiment of the present invention. This embodiment consists of a crude splitter; a hydrogen supply; a gas treater; a diesel hydrotreater; a naphtha stabilizer; boilers; and furnaces. Ultralight fluid is preheated and then desalted to remove inorganic contaminants. The desalted fluid is further heated to produce a vapor/liquid mixture. The fluid is then supplied via line 20 to an atmospheric crude distillation column ("crude splitter") 22. The crude splitter 22 outputs several streams, including naphtha via line 24, diesel via line 26, offgas via line 28, and bottoms via line 30.

The naphtha (i.e., light hydrocarbon) in line 24 is directed to a naphtha stabilizer (i.e., stripper) 32 and it is joined with additional naphtha carried in line 34 before entering the naphtha stabilizer 32. The naphtha stabilizer stabilizes the naptha by removing the highly volatile, light hydrocarbons thereby reducing the Reid Vapor Pressure "RVP" to an acceptable level and then sent to storage for naphtha sales.

The diesel in line 26 is directed to a diesel hydrotreater 36—which in some embodiments might experience one percent (1%) volume loss—the diesel hydrotreater 36 receives a feed of hydrogen gas from a hydrogen supply 38. In the diesel hydrotreater 36, the diesel from line 26 hydrogen and catalyst to produce several outputs. The diesel hydrotreater 36 outputs several streams, including the naphtha in line 34, ULSD via line 40, offgas via line 42 and a fourth line 44. The fourth line passes accidentally reacted material back and forth between the naphtha stabilizer 32 and the diesel hydrotreater 36.

The offgas in line 28 is directed to a gas treater 46 and it is joined with additional offgas in line 42 and offgas in line 48. The offgas in line 48 is an output from the naphtha stabilizer 32. The naphtha stabilizer 32 outputs several streams, including the offgas in line 48, LPG in line 50, and naphtha in line 52.

The gas treater 46, which takes raw gas as an input, contacts the gas with a caustic solution to remove hydrogen sulfide, and provides low sulfur off gas as output via line 54. The low sulfur off gas as in line 54 is directed to furnaces 56 and boilers 58. Furnaces 56, which take low sulfur off gas as input, provide heat for various process streams such as distillation and catalytic reaction. And boilers 58, which take low sulfur off gas and water as inputs, provide steam 60 as an output.

The bottoms in line 30 are directed to bottoms storage 62 and the bottoms in line 30 are joined with some naphtha in line 24 before entering the bottoms storage 62. Before the entering bottoms storage, the bottoms are cooled and after storage will eventually be sold for marine fuel oil sales—or similar applications.

Other output streams from this embodiment are directed to product storage. The LPG in line 50 is fed to LPG storage 64. The naphtha in line 52 is fed to naphtha storage 66. The ULSD in line 40 is fed to ULSD storage 68.

The supply of ultralight fluid can be adjusted in alternative embodiments. However, it is envisioned that a supply of 10,000 barrels per day ("BPD") input of ultralight fluid will result in final products in the following proportions: 0 BPD of LPG; 4,432 BPD of naphtha; 4,701 BPD of ULSD; and 5,096 BPD of bottoms, 699 BPD of which are reconstituted crudes.

Figure 2A:
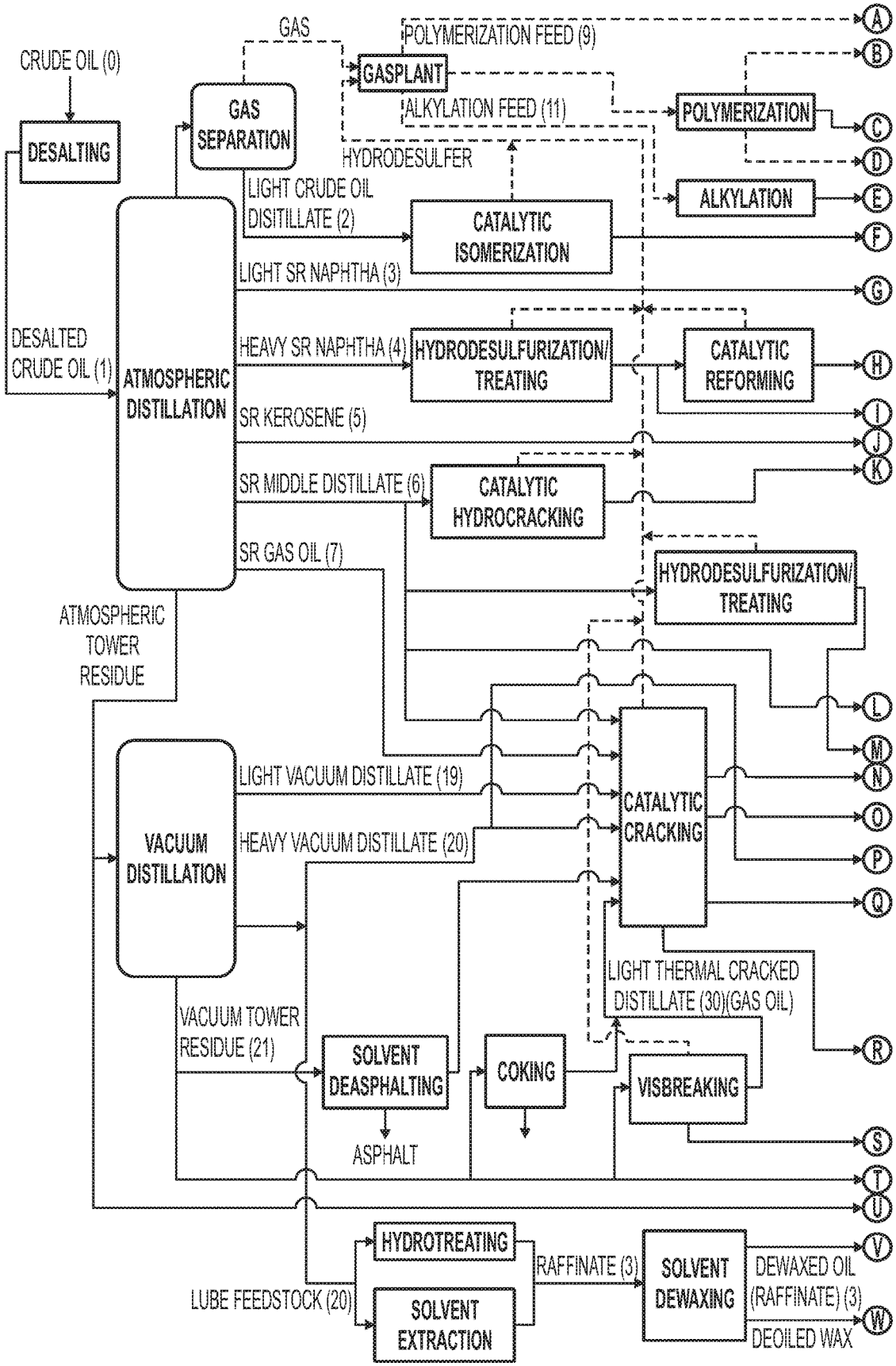
FIG. 2A and FIG. 2B are a block flow diagram of a typical refinery for heavier crude oil.
Figure 2B:
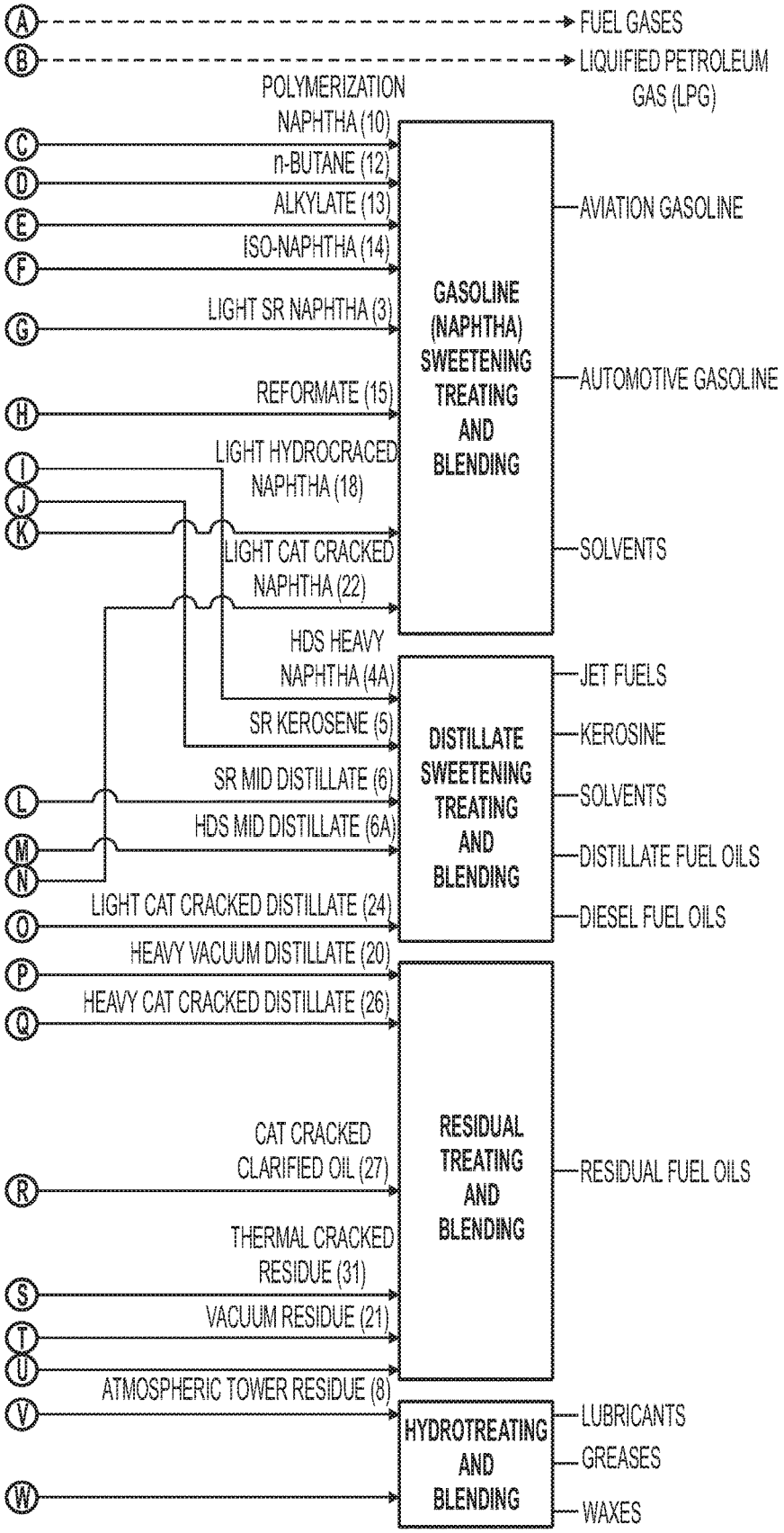

FIGS. 2A and 2B illustrates the units and their arrangement in a typical refinery for crude oils. Most of the units and products derived therefrom are not required or used in the present invention.

Existing refineries are designed to process heavier crude oil. Such refineries have extraordinary expense and challenges that are avoided with the present invention, which is designed to process light crude oil and condensate. For instance, separate the heavier crude oil into several components using atmospheric distillation, vacuum distillation, naphtha fractionation, LPG fractionation, and solvent deasphalting. By focusing on ultra-light fluid, the present invention separates the light crude oil into a limited number of components using only atmospheric distillation. Stated differently, ultralight fluid is distinguished from heavier crude oil, in part, by the high sulfur content found in heavier crude oil. As a result, existing refineries are forced to remove large amounts of sulfur. Such a refinery is complex and involves: 30-60% gas oil required to be cracked; 5-40% asphalt which must be cooked or sold as high sulfur asphalt or fuel oil; lots of hydrogen; extensive utilities—cooling towers, boilers, BFW treating, waste water treatment, etc.; and end products are typically blended. The present invention only has 5-20% bottoms; no asphalt or fuel oil; minimal blending; minimal tankage; and minimal utilities.

Also with respect to sulfur, existing refineries convert hydrogen sulfide ("$H_2S$") to elemental sulfur via Claus sulfur plants, which require tail gas units for environmental compliance. By contrast, the present invention converts hydrogen sulfide to sodium sulfides using a caustic scrubber.

With respect to cracking, existing refineries convert heavy hydrocarbon molecules to lighter hydrocarbon molecules via "cracking" in units such as fluid catalytic crackers and hydrocrackers. The present invention does not "crack" heavy hydrocarbon molecules since these molecules are suited for direct use as marine fuel oil due to low sulfur content.

Existing refineries involve multiple components, which must be balanced. For example, it is not uncommon to find the following components present (with relevant octane levels):

FCC gasoline (87);
reformate upgraded from 65 (85-98);
alkylate (93-98);
ethanol/MTBE (115); and
Light straight run naphtha (65-75).

As mentioned, existing refineries require large quantities of hydrogen. To meet the demands, existing refineries produce hydrogen via naphtha reforming or steam methane reforming processes and systems. By contrast, the present invention does not produce hydrogen since only a small amount is needed for the small amounts of sulfur. Instead, the present invention calls for a small hydrogen supply.

Existing refineries convert olefinic LPG to alkylate via hydrogen fluoride ("HF") or hydrogen sulfate ("H2SO4") alkylation units to produce high octane gasoline. The present invention does not produce gasoline nor does it produce olefinic LPG. Thus, such alkylation units are not necessary.

Existing refineries contain debutanizers, depropanizers, and other LPG equipment to separate the various LPG components into finished products. By contrast, the present invention does not produce LPG as it uses the relatively small amount of LPG contained in the crude oil as an internal fuel source. As discussed below, certain embodiments might produce small quantities of LPG. In those instances, the small quantities do not necessitate debutanizers, depropanizers, and other LPG equipment to separate the various LPG components into finished products. The small quantities of produced LPG are used as an internal fuel source.

Land cost and acquisition—along with related expenses—are extraordinary in existing refineries, which contain extensive tank farms covering up to several hundred acres. The large space is required due to the number of finished products, unfinished products, and feedstock storage. By contrast, the present invention requires only fifteen (15) acres for the process equipment and tanks utilized.

Existing refineries require extensive staffs of operators, maintenance personnel, technical, supervisory, and other support staff: frequently several hundred in number. By contrast, the present invention requires two operators per shift and only a few maintenance personnel.

Existing refineries require up to three years to add or expand process units due to complexity of environmental permitting, the need to fit into existing plot space, and the arduous task of building in a hazardous space. By contrast, the present invention is expected to require only twelve months to design, build, and startup due to the simplicity of environmental permitting and greenfield construction.

Existing refineries cost as much as several billion dollars. By contrast, the present invention costs on the magnitude of fifty million dollars to construct and implement.

The present invention improves several logistics concepts. The present invention is ideally located at, or near, production sites. Hydraulic fracturing requires significant quantities of diesel to fuel equipment required during drilling and completion. Remote locations often see much higher prices due to transportation costs.

If the invention is implemented at a transportation hub, a larger facility could export products via rail, truck, or pipeline. This option is well suited for stringent specifications required for product exports to Mexico.

When the entire facility is designed in modules, it can be assembled under controlled conditions in a fabrication shop. Onsite assembly consists of setting modules on foundation and connecting piping, conduit, etc. Minimal utilities required to support system. Operator staffing is minimal due to advanced process controls.

Catalyst that might be used include: standard cobalt molybdenum or standard nickel molybdenum (hydrotreating catalyst) and catalysts with similar properties.

Figure 3:
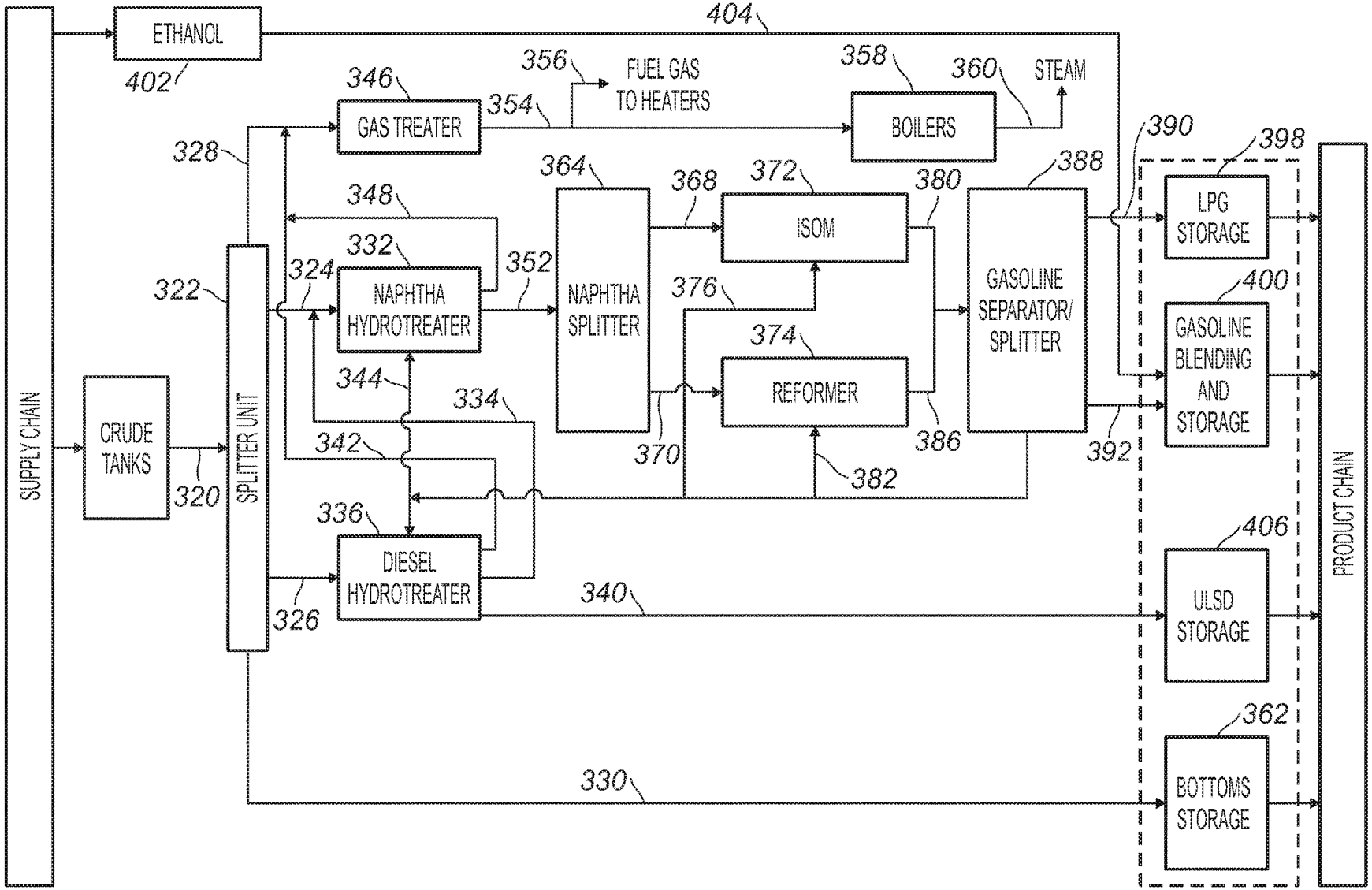
FIG. 3 is a block flow diagram schematic showing an alternative refining system that may be used for upgrading ultralight crude oil and condensates.

One of ordinary skill in the art will appreciate a variety of embodiments that capture the spirit of the present invention. For instance, other unit operations may be included and arranged. FIG. 3 shows a flow diagram schematic of another upgrading system generally designated by the numeral 300. This embodiment consists of a crude splitter; a gas treater; a diesel hydrotreater; a naphtha hydrotreater; a naphtha splitter; an isomerization unit; a naphtha reformer; a gasoline separator/splitter; boilers; and furnaces.

Desalted crude oil is heated to produce a vapor/liquid mixture. This ultralight fluid is supplied via line 320 to an atmospheric crude distillation column (i.e., crude splitter) 322. The crude splitter 322 outputs several streams, including naphtha via line 324, diesel via line 326, offgas via line 328, and bottoms via line 330.

The naphtha (i.e., light hydrocarbon) in line 324 is directed to a naphtha hydrotreater 332 and it is joined with additional naphtha carried in line 334 before entering the naphtha hydrotreater 332. The naphtha hydrotreater contacts the naphtha with hydrogen and a catalyst, which as discussed below results in sulfur-free naphtha and raw gas as outputs. The naphtha hydrotreater 332 experiences zero percent (0%) volume loss.

The diesel in line 326 is directed to a diesel hydrotreater 336—which in some embodiments might experience one percent (1%) volume loss—the diesel hydrotreater 336 receives a feed of hydrogen gas from a hydrogen supply 338, which may be provided from a devoted unit/hydrogen supply or as an output from a downstream unit such as a gasoline separator/splitter. In the diesel hydrotreater 336, the diesel from line 326 hydrogen and catalyst to produce several outputs. The outputs are directed via several streams, including the naphtha in line 334, ULSD via line 340, offgas via line 342, and a fourth line 344 containing accidentally reacted material. The fourth line passes fluid back and forth between the naphtha hydrotreater 332 and the diesel hydrotreater 336.

The offgas in line 328 is directed to a gas treater 346 and it is joined with additional offgas in line 342 and offgas in line 348. The offgas in line 348 is an output from the naphtha hydrotreater 332. The naphtha hydrotreater 332 outputs several streams, including the offgas in line 348, and naphtha in line 352.

The gas treater 346, which takes raw gas as an input, contacts the gas with a caustic solution to remove hydrogen sulfide, and provides low sulfur off gas as output via line 354. The low sulfur off gas as in line 354 splits and directed to furnaces 356 and boilers 358. Furnaces 356, which take low sulfur off gas as input, provide heat for various process streams for distillation and catalytic reaction. And boilers 358, which take low sulfur off gas and water as inputs, provide steam 360 as an output.

The bottoms in line 330 are directed to bottoms storage 362 and the bottoms in line 330 are joined with some naphtha in line 324 before entering the bottoms storage 362. Before entering the bottoms storage 362, the bottoms are cooled and after storage will eventually be sold for marine fuel oil sales—or similar applications.

The naphtha in line 352 is fed to a naphtha splitter 364. The naphtha splitter unit 364 consists of a series of distillation columns and enables the successful separation of light naphtha and heavy naphtha. The naphtha splitter 364 outputs liquefied petroleum gas ("LPG") in line 366 (not shown), sulfur-free light naphtha in line 368, and sulfur-free heavy naphtha in line 370. The sulfur-free light naphtha in line 368, and the sulfur-free heavy naphtha in line 370 are output at a ratio of 1863:2372 by volume, in this particular embodiment.

The sulfur-free light naphtha in line 368 is fed to an isomerization unit 372—which in some embodiments might experience one percent (1%) volume loss. During isomerization, the sulfur-free light naphtha contacts hydrogen fed from line 376 and isomerization catalyst 378 (not shown). The isomerization unit 372 produces isomerate and LPG, which is output in line 380.

The sulfur-free heavy naphtha in line 370 is fed to a naphtha reformer 374—which in some embodiments might experience twelve percent (12%) volume loss. During the reforming process, the sulfur-free heavy naphtha from line 370 contacts hydrogen fed from line 382 and reformer catalyst 384 (not shown). The reformer 374 produces high-octane liquid reformate and LPG, which is output in line 386 and additional hydrogen gas.

The isomerate and LPG in line 380, along with the reformate and LPG in line 386, are both fed to a gasoline separator/splitter 388. The gasoline separator/splitter outputs LPG via line 390, gasoline via line 392, and hydrogen gas via line 394. The hydrogen from line 394 is reused in the process at several unit operations, including the isomerization unit 372, the reformer 374, and the fourth line 344 containing accidentally reacted material.

The bottoms in line 330 are directed to a bottoms storage 362. Before the entering bottoms storage, the bottoms are cooled and after storage will eventually be sold for marine fuel oil sales—or similar applications. Other product streams from this embodiment are directed to product storage. The LPG in line 390 is fed to LPG storage 398. The gasoline in line 392 is fed to gasoline storage 400, where it blends with ethanol from an ethanol supply 402 via an ethanol line 404. The ULSD in line 340 is fed to ULSD storage 406.

The supply of ultralight fluid can be adjusted in alternative embodiments. However, it is envisioned that a supply of 10,000 barrels per day ("BPD") input of ultralight fluid—along with 500 BPD of ethanol supplied from ethanol supply 402—will result in final products in the following proportions: 110 BPD of LPG; 4,432 BPD of gasoline; 4,701 BPD of ULSD; and 699 BPD of bottoms.

In a further embodiment, bottoms carried away from the crude splitter could be upgraded by way of a hydrocracker. In such an embodiment, the hydrocracker takes the bottoms (i.e., low sulfur marine fuel oil) as an input, contacts the bottoms with catalyst and hydrogen, and provides raw naphtha, liquified petroleum gas, ultra-low sulfur diesel, and ultra-low sulfur marine fuel oil as outputs.

The present invention results in a simpler refinery because of the light condensate feed, and three functions are necessary: separate crude into three streams that boil in gasoline, diesel, and fuel oil ranges; the distillate hydrotreater removes sulfur to meet ULSD specifications; gasoline section removes sulfur and changes octane from low values to high values that meet 87 regular gasoline specifications; and fuel oil meets lower sulfur specifications without further treatment. And by using only LSR and HSR, the user can upgrade LSR to 85-92 octane; not upgrade HSR; avoid twenty percent (20%) shrinkage for HSR; and no shrinkage across the LSR upgrade.

In certain embodiments, the system and process of the invention use advanced technology for optimized results, including: compact heat exchanger technology; high integrity protection methodology; MaxFlux technology, patented by Duke Biofuels, LLC and distributed control technology, patented by Emerson.

In some embodiments the construction and implementation uses modular construction techniques. For instance, pumps, exchangers, control valves, and other equipment may be located on modules, while certain reactors, columns, and tanks can be located on field-constructed foundations.

In certain embodiments where an ULSD hydrotreater is used, three streams are produced: a low sulfur diesel product, which is sent to storage for ULSD sales; a light hydrocarbon stream, which is routed to the splitter for separation into naphtha and vapor/gas; and a hydrogen rich vapor/gas stream which is treated to H2S and used as fuel for the heaters and boilers.

The present invention is described above in terms of a preferred illustrative embodiment in which a specifically described refining plant and method are described. Those skilled in the art will recognize that alternative constructions of such an apparatus, system, and method can be used in carrying out the present invention. Other aspects, features, and advantages of the present invention may be obtained from a study of this disclosure and the drawings, along with the appended claims.

We claim:

1. A method of upgrading ultralight crude oil and condensates comprising the steps of:

feeding a stream of ultralight crude oil to a condensate splitter unit, the stream of ultralight crude oil having one or more of the following attributes: an API gravity between 46 and 58, a sulfur content less than 0.1%, or Reid vapor pressure between 5 and 15 psig;

splitting a first stream of NAPHTHA, and a first stream of diesel from the condensate splitter unit;

feeding at least part of the first stream of NAPHTHA to a NAPHTHA stabilizer to form a product stream of NAPHTHA; and feeding the first stream of diesel from the splitter unit to a diesel hydrotreater and introducing a stream of hydrogen to form a product stream of ultra-low sulfur diesel.

2. The method of claim 1 further comprising the step of feeding a second stream of NAPHTHA from the diesel hydrotreater to the first stream of NAPHTHA.

3. The method of claim 1 further comprising the step of forming a stream of liquid petroleum gas from the NAPHTHA stabilizer.

4. A method of upgrading ultralight crude oil and condensates comprising the steps of:

feeding a stream of ultralight crude oil to a condensate splitter unit, the stream of ultralight crude oil having one or more of the following attributes: an API gravity between 46 and 58, a sulfur content less than 0.1%, or Reid vapor pressure between 5 and 15 psig;

splitting a first stream of NAPHTHA, and a first stream of diesel from the condensate splitter unit;

feeding at least part of the first stream of NAPHTHA to a NAPHTHA hydrotreater to form a hydrotreated stream of NAPHTHA; and feeding the first stream of diesel from the splitter unit to a diesel hydrotreater and introducing a stream of hydrogen to form a product stream of ULSD ultra-low sulfur diesel;

feeding the hydrotreated stream of NAPHTHA to a NAPHTHA splitter unit;

splitting a stream of light NAPHTHA and a stream of heavy NAPHTHA from the NAPHTHA splitter;

feeding the stream of light NAPHTHA to an isomerization unit to form at least a stream of isomerate;

feeding the stream of heavy NAPHTHA to a reformer unit to form at least a stream of reformate;

feeding the stream of isomerate and the stream of reformate to a gasoline separator and forming at least a product stream of gasoline.

5. The method of claim 4 further comprising the step of feeding a second stream of NAPHTHA from the diesel hydrotreater to the first stream of NAPHTHA.

6. The method of claim 4 further comprising the step of forming a stream of liquid petroleum gas from the NAPHTHA stabilizer.

7. The method of claim 4 further comprising the step of forming a stream of LPG from the isomerization unit.

8. The method of claim 7 further comprising the step of producing a product stream of LPG from the gasoline separator.

9. The method of claim 4 further comprising the step of forming a stream of LPG from the reformer unit.

10. The method of claim 9 further comprising the step of producing a product stream of LPG from the gasoline separator.

11. The method of claim 1 performed without performing the step of hydrosulferization.

12. The method of claim 1 comprising the step of splitting a first stream of offgas from the condensate splitter unit and introducing the first stream of offgas to a caustic scrubber.

13. The method of claim 12 comprising the step of using the caustic scrubber to convert hydrogen sulfide to form at least one stream of sodium sulfides.

14. The method of claim 1 without splitting a stream of LPG from the condensate splitter unit.

* * * * *